United States Patent [19]

Grootherder et al.

[11] Patent Number: 4,462,537

[45] Date of Patent: Jul. 31, 1984

[54] EGG CONTAINER

[76] Inventors: Hendrikus Grootherder, No. 31 Arnhemsestraat, 6971 AP Brummen; Hendrik J. Grootherder, No. 13 Knoevenoordstraat, 6971 LG Brummen, both of Netherlands

[21] Appl. No.: 309,471

[22] Filed: Oct. 7, 1981

[30] Foreign Application Priority Data

Oct. 21, 1980 [NL] Netherlands ..... 8005790

[51] Int. Cl.[3] ..... B65D 45/00

[52] U.S. Cl. ..... 229/45 EC; 229/2.5 EC; 229/44 EC; 206/505; 206/515

[58] Field of Search ..... 229/2.5 EC, 44 EC, 29 D, 229/29 E, 15, 27, 45 EC; 217/18; 206/503, 505, 515, 516, 520

[56] References Cited

U.S. PATENT DOCUMENTS

| | | | |
|---|---|---|---|
| 2,285,129 | 9/1938 | Schwartzberg | 229/2.5 EC |
| 2,600,130 | 6/1952 | Schilling | 229/2.5 EC |
| 3,034,693 | 5/1962 | Cox | 229/45 EC |
| 3,162,352 | 12/1964 | Swaim | 229/2.5 EC |
| 3,217,961 | 11/1965 | Hornbostel, Jr. | 229/45 EC |
| 3,314,588 | 4/1967 | Rodish | 229/29 D |
| 3,392,902 | 7/1968 | Donovan | 229/44 EC |
| 3,476,306 | 11/1969 | Eisenberg | 229/44 EC |
| 3,519,189 | 7/1970 | Bambara et al. | 229/45 EC |
| 3,647,132 | 3/1972 | Crabtree | 229/44 EC |
| 3,749,235 | 7/1973 | Boursier | 229/2.5 EC |

FOREIGN PATENT DOCUMENTS

| | | | |
|---|---|---|---|
| 1225029 | 3/1971 | United Kingdom | 229/2.5 EC |

*Primary Examiner*—Joseph M. Moy
*Assistant Examiner*—David Fidei
*Attorney, Agent, or Firm*—Birch, Stewart, Kolasch & Birch

[57] ABSTRACT

The invention relates to a box for transporting and selling eggs in fixed amounts, said box comprising a bottom part and a cover part and being provided with standing elements adjoining the bottom part of the box for separately supporting each egg, said boxes being interengageable and nestable in a direction perpendicular to their bottoms in the empty and tilted-up state. According to the invention the standing walls of the bottom part and those of the cover part are at least substantially flat and are tapering from their basic surfaces downwards and upwards respectively.

6 Claims, 12 Drawing Figures

EGG CONTAINER

BACKGROUND AND SUMMARY OF THE INVENTION

The invention relates to a box for transporting and selling eggs in fixed amounts, said box comprising a bottom part and a cover part and being provided with standing elements adjoining the bottom part of the box for separately supporting each egg, said boxes being interengageable and nestable in a direction perpendicular to their bottoms in the empty and tilted-up state.

Boxes of this kind are known, It is common practice to make the known boxes from pulp or foam material. Usually the standing elements are formed by parts of the inner surface of the box together with the outer surfaces of more or less pyramidal elements formed integrally therewith. These pyramidal elements usually extend not only from the bottom but also from the cover surface. With this conventional shape the cover part exhibits, viewed from the outside, a number of recesses corresponding to the pyramidal elements extending down from the cover part.

The known box of the kind briefly described above has some limitations.

In the first place, due to the presence of recesses in the cover, the possibility of applying a test to said cover is limited.

Moreover, the possibilities of high-grade printing are strictly limited by the conventional material used.

A third limitation of the known boxes resides in that the surfaces and particularly the side surfaces in the longitudinal direction of the box are not appropriate for applying texts, advertising terms and the like.

In order to eliminate the aforesaid disadvantages it has been proposed to provide the conventional egg box of said type after being filled with eggs with a printed sleeve carrying the desired texts, photographs, advertisements and the like. Such a sleeve has to be arranged around the box in a separate operation, which is time-consuming. Moreover, the sleeve brings about additional costs.

The invention has for its object to obviate the said disadvantages and provides to this end a box of the type described in the preamble, in which the standing walls of the bottom part and those of the cover part are at least substantially flat and are tapering from their basic surfaces downwards and upwards respectively.

This results in a substantially rectangular top surface and substantially flat standing walls of the bottom part and the cover part. Particularly when the material is appropriately chosen, for example, printable cardboard, external printing of excellent quality can be obtained, for example, in three or four colours.

Particular advantages are involved in the embodiment of the egg box according to the invention in which the standing supporting elements are formed on at least one separate insert element placed in the bottom part. This insert may be made of foam or pulp material. This embodiment has the advantage that the box is eminently suitable for planar structures so that printing can be carried out in advance on the flat form. This printing may comprise a code known per se, which can be automatically read and contains data about the kind of article, price and so on. The known box does not permit such encoding.

BRIEF DESCRIPTION OF THE DRAWINGS

The invention will now be described more fully with reference to a drawing of a few arbitrary embodiments, to which the invention is, however, not limited.

The drawing shows in

DETAILED DESCRIPTION OF THE INVENTION

Figure 1:
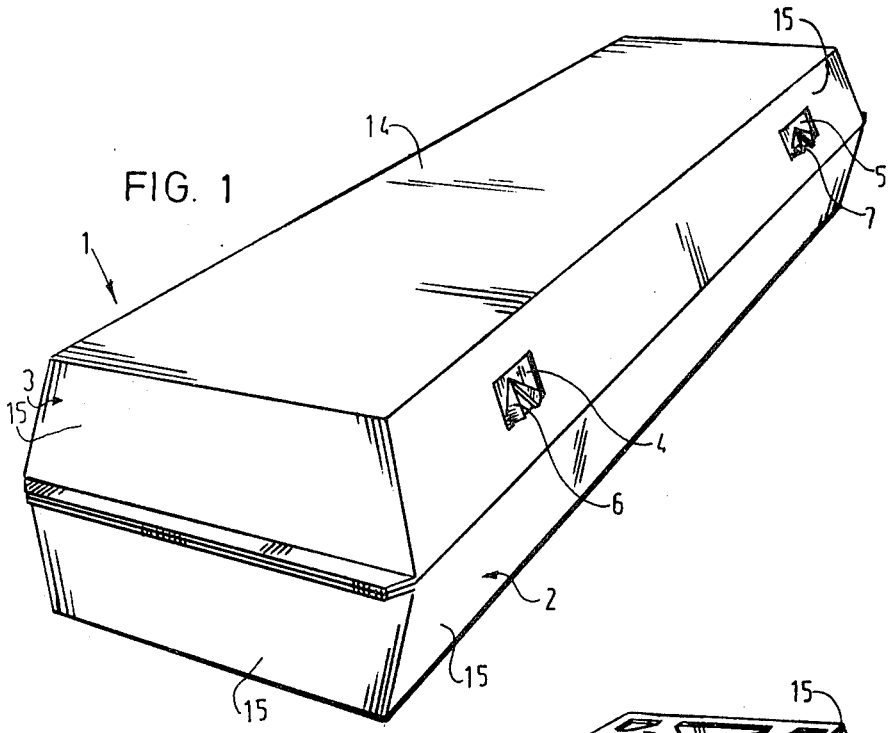
FIG. 1 a perspective plan view of a first embodiment of the box in accordance with the invention, FIG. 2 a perspective bottom view of the box shown in FIG. 1, FIG. 3 a perspective plan view of the box shown in FIGS. 1 and 2 in the exploded state, FIG. 4 a front view of a stack of printed boxes embodying the invention, FIG. 5 the blank forming the bottom part and the cover part of the box of FIGS. 1, 2 and 3, FIG. 6 a cross-sectional view of the box shown in FIGS. 1, 2 and 3, FIG. 7 a cross-sectional view of a stack of boxes shown in FIGS. 1, 2 and 3 corresponding with the cross-sectional view of FIG. 6, FIG. 8 a second embodiment of a box in accordance with the invention, FIG. 9 a third embodiment of a box in accordance with the invention, FIG. 10 a sectional view taken on the line X—X in FIG. 8 and FIG. 11 a cross-sectional view taken on the line XI—XI in FIG. 9.

FIG. 1 shows a preferred embodiment of a box 1 according to the invention. This box 1 comprises a bottom part 2 and a cover part 3. The cover part 3 of the embodiment shown has two holes 4, 5 adapted to cooperate with slightly resilient snap elements 6, 7 connected with the bottom part 2 for holding the cover part 3 with respect to the bottom part 2 in the closed state after the box 1 is filled with eggs.

Figure 2:
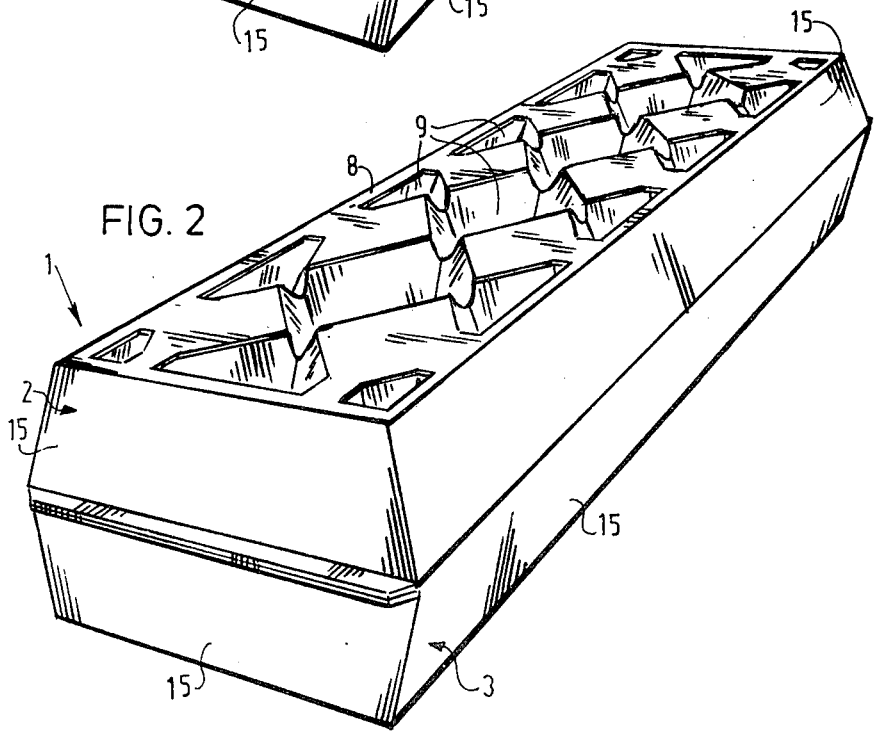

FIG. 2 shows the box 1 in the inverted state. In anticipation of the further description of the box 1 it is noted here that in the underside 8 the bottom part 2 has a partly open structure with holes 9 to enable nesting.

Figure 3:
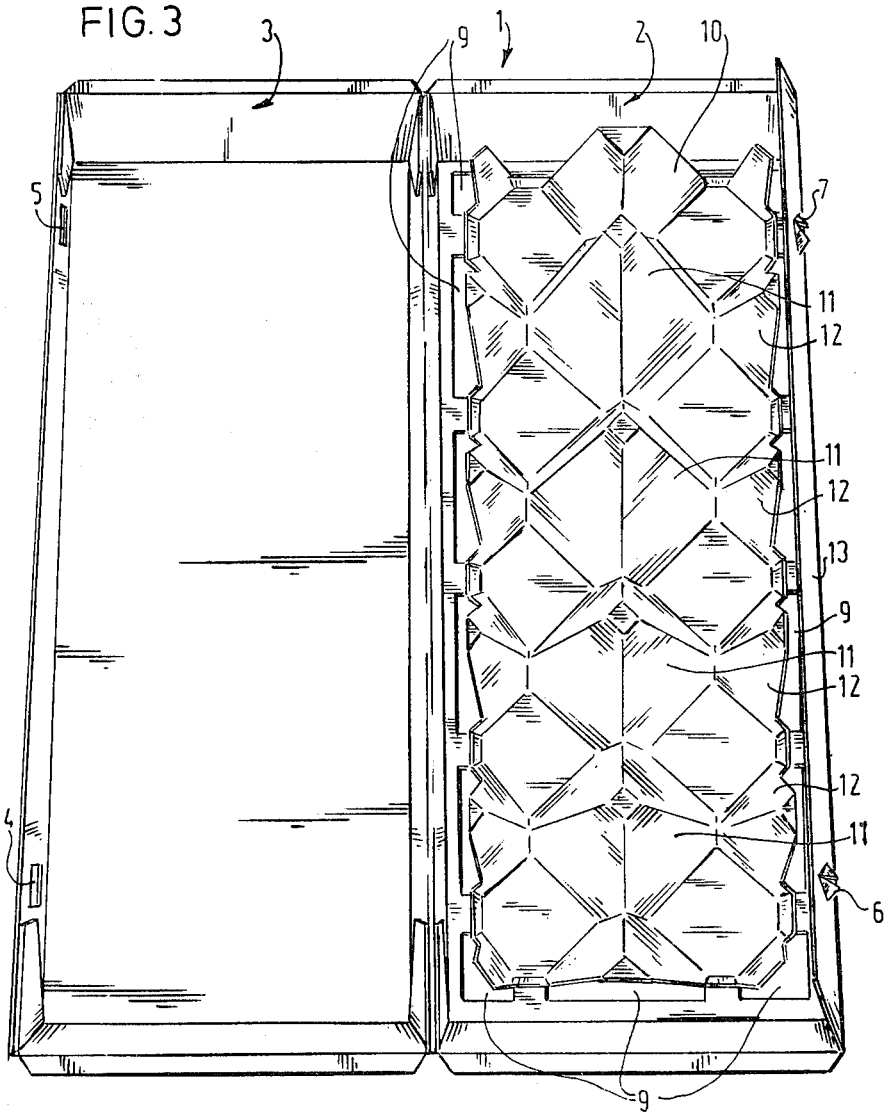

FIG. 3 shows the box 1 in the open state.

The above mentioned, standing supporting elements are formed, as will be apparent from FIG. 3, on a separate insert element 10 disposed in the bottom part 2. This insert element 10 may be made from soft synthetic resin or pulp material and has a row of pyramids 11 and pyramid parts arranged around the former and designated in general by 12. From FIG. 3 it is furthermore apparent how the holes 9 in the bottom surface correspond to the shapes and the positions of the pyramids 11 and the pyramid parts 12 to enable nesting.

It will furthermore be seen from FIG. 3 that the snap elements 6 and 7 are formed on a flap 13 extending along an upper longitudinal rim of the bottom part 2. The the other upper longitudinal rim is adapted to pivot the cover part 3.

Referring to FIGS. 1 to 3 it will be apparent that the top surface 14 and also all side surfaces commonly designated by reference numeral 15 are excellently suitable for printing.

Figure 4:
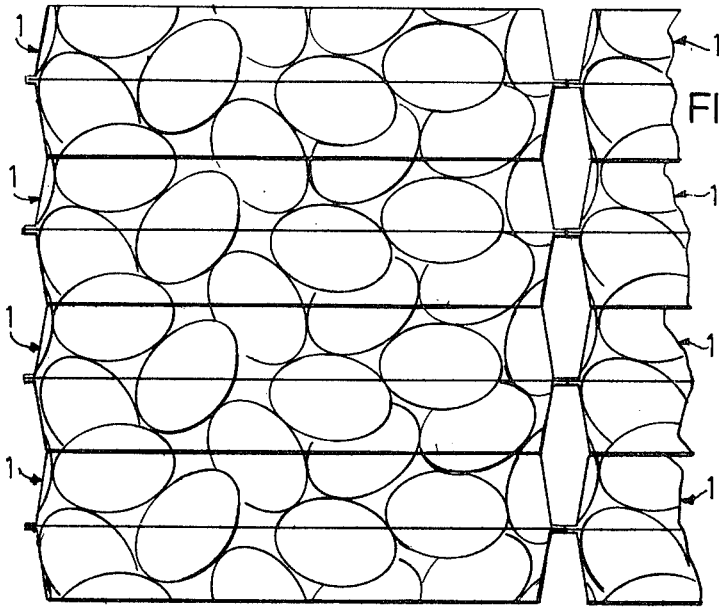

FIG. 4 shows a stack of boxes 1 embodying the invention provided with printing corresponding to a photograph of eggs. The consumer viewing such a stack in a shop thus observes a particularly fresh and attractive pile of eggs, which stimulates the turnover of these products. It is noted that in the embodiment of FIG. 4 the photograph is such that the patterns adjoin one another so that a very nice, homogeneous image is obtained.

Figure 5:
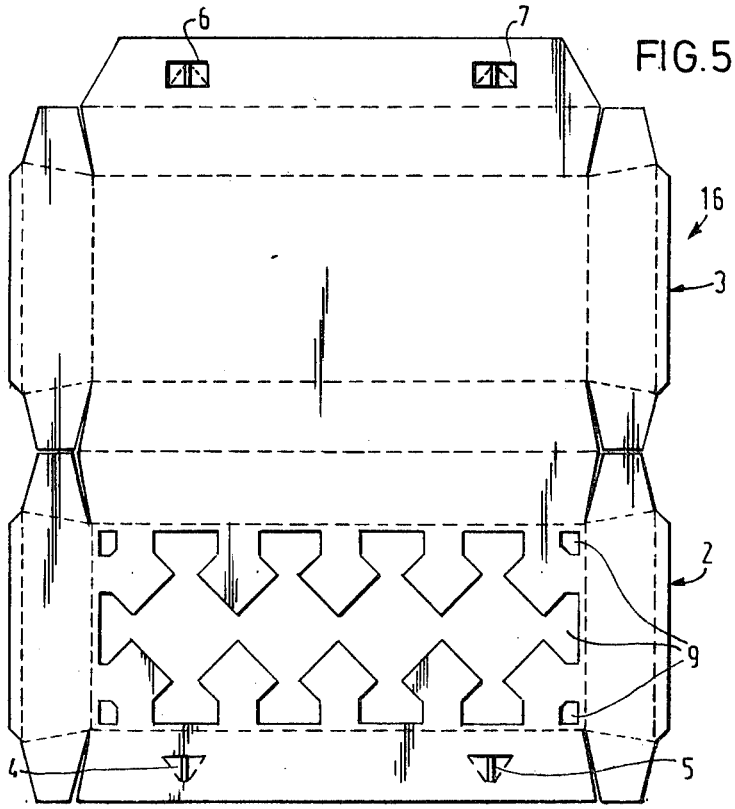

FIG. 5 shows a blank 16 comprising the bottom part 2 and the cover part 3 of the box of FIGS. 1 to 3 in a flat shape.

Figure 6:
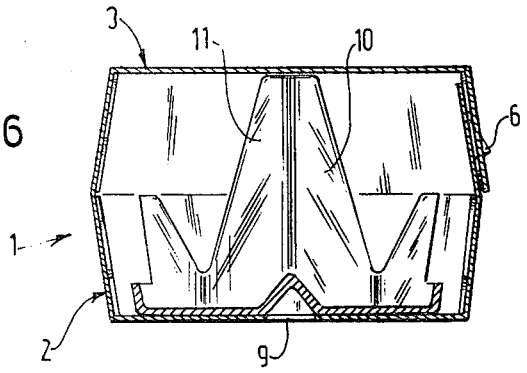

FIG. 6 is a cross-sectional view of the box 1. It will be apparent that the pyramidal element 11 has a height such that it serves in addition as a support for the cover 3.

Figure 7:
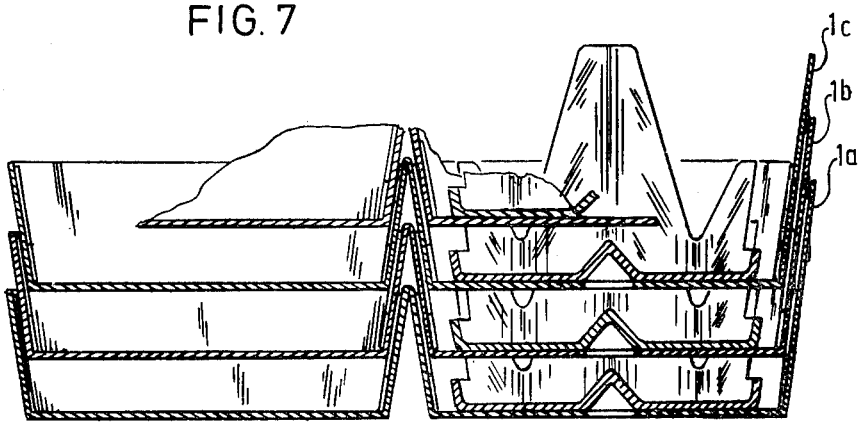

FIG. 7 shows an elevational view corresponding with FIG. 6 of a number of boxes 1, 1*a* and 1*b*, 1*c* . . . piled up in the opened and empty state. The egg dealer receives the boxes in this piled-up state. The stacks of boxes can be denested manually or mechanically in known manner, filled and prepared for transport in the closed state. The abovementioned manipulation according to the prior art for sliding a sleeve around the filled boxes can thus be omitted.

Figure 8:
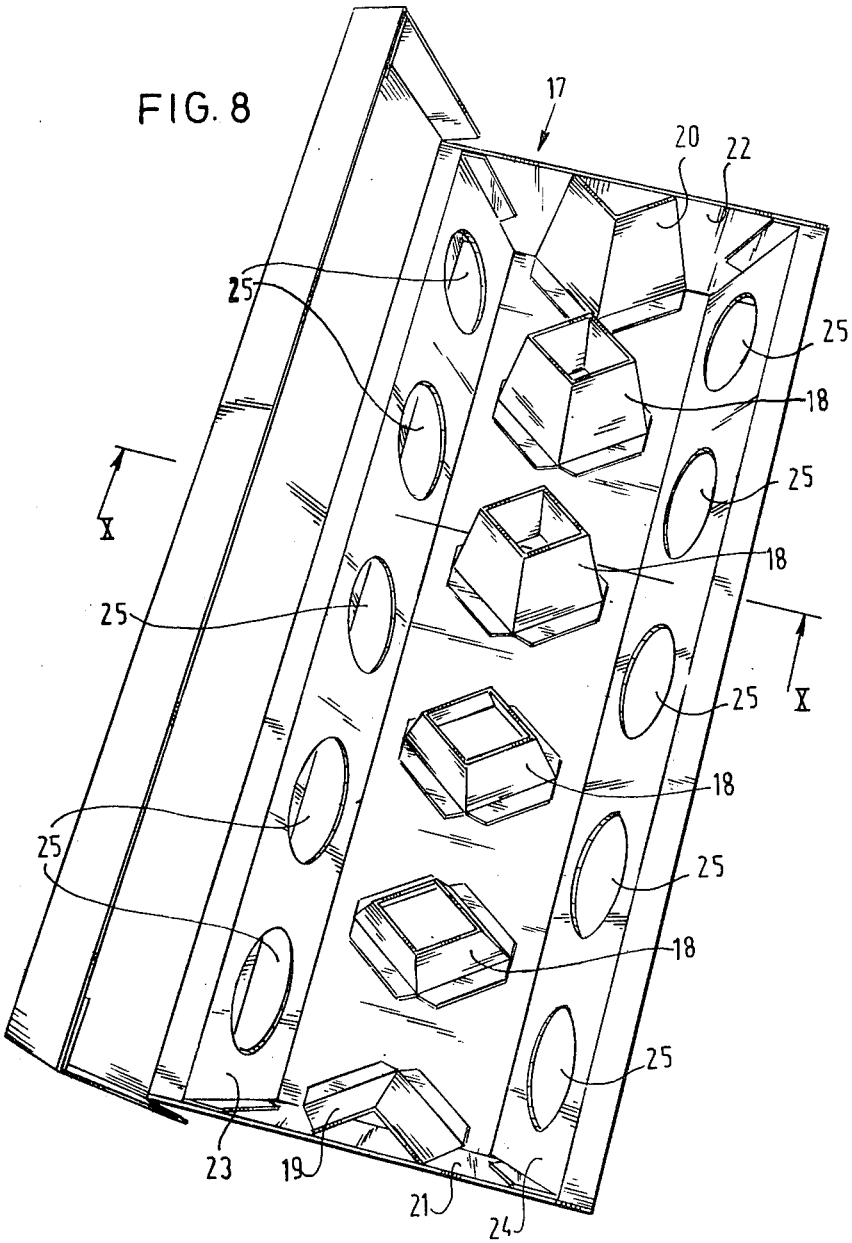

FIG. 8 shows a second embodiment 17. This box 17 comprises a plurality of frustopyramidal elements 18 and partly truncated pyramids 19, 20 adjoining the head walls 21 and 22 respectively. There are furthermore two long sidewalls 23, 24 having holes 25 at places located between the axial positions of the pyramidal elements 18, 19. It will be obvious that in the configuration shown the eggs are supported on the one hand by the side surfaces of the elements 18, 19 and on the other hand by the peripheries of the holes 25.

Figure 10:
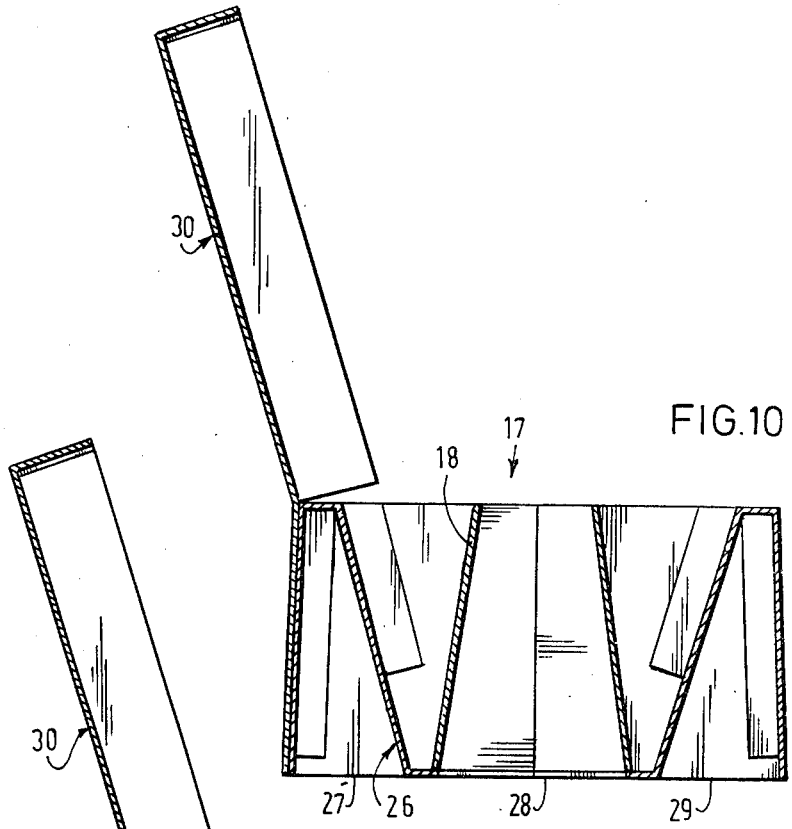

FIG. 10 is a cross-sectional view taken on the line X—X in FIG. 8. The shape of the bottom part 26 is clearly shown with its surfaces tapering from the bottom to top. In this case the standing elements are integral with the bottom part 26. The surfaces designated 27, 28, 29 are not materially present; their function corresponds with that of the holes 9 of the first embodiment described above.

With the bottom part 26 is connected a cover part 30.

Figure 9:
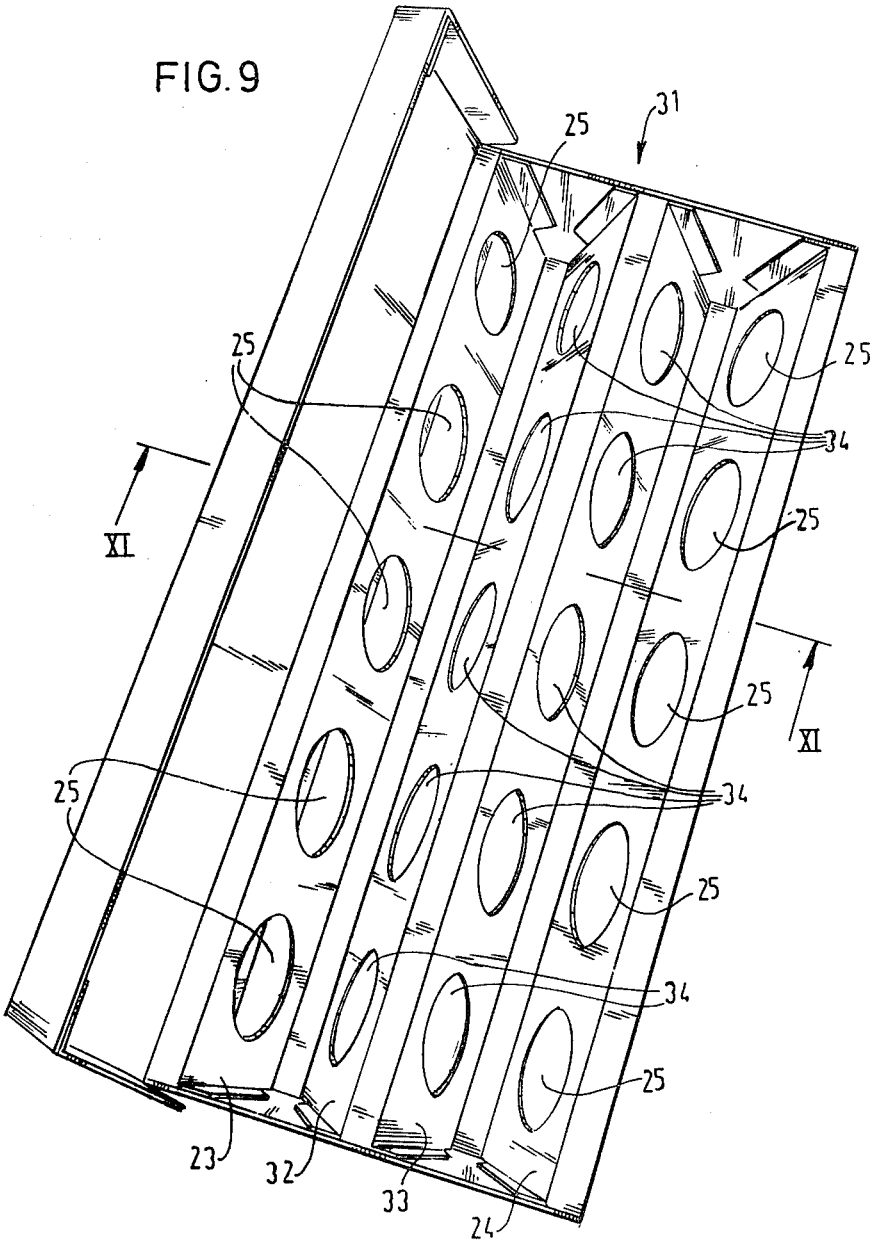

FIG. 9 shows a third embodiment 31. This embodiment partly corresponds with the second embodiment of FIGS. 8 and 10. Corresponding elements are, therefore, designated by the same reference numerals. In contrast to the second embodiment of FIGS. 8 and 10 the middle of the box 31 does not have a row of pyramidal elements 18, 19, instead two further walls 32, 33 are arranged opposite the walls 23 and 24 respectively, said walls 32, 33 having holes 34 at positions corresponding with those of the holes 25. It will be apparent that in this third embodiment the eggs are supported on the one hand by the rims of the holes 25 and on the other hand by the rims of the holes 34.

Figure 11:
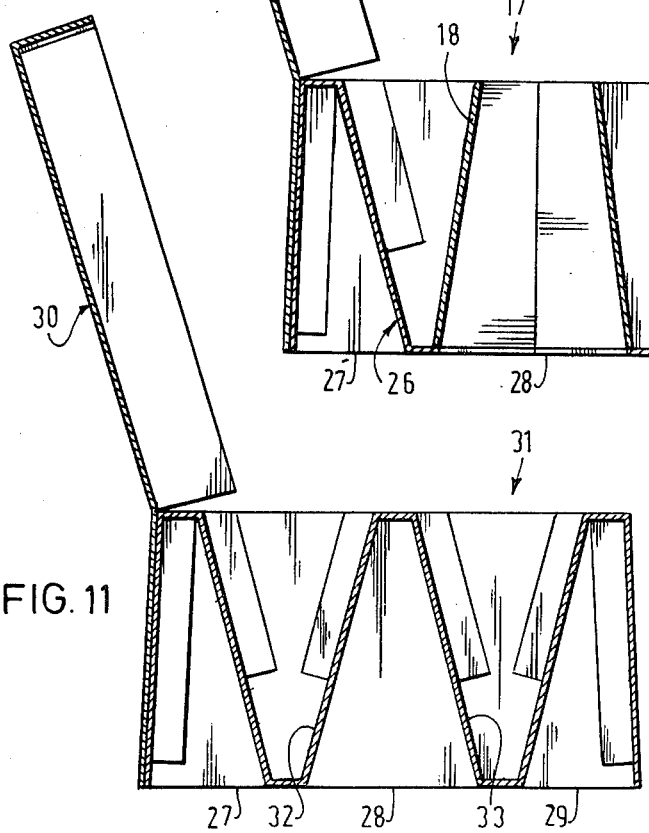

Like in the case of the first embodiment with the insertion 11 of given height, the elements 18, 19 of the second embodiment and the walls 32, 33 of the third embodiment have a height such that they can support the flat cover part 30. FIG. 11 also shows non-material surfaces 27, 28, 29, which enable nesting of the boxes 31.

With respect to the second and third embodiments it is furthermore noted that with regard to nestability the side surfaces of the cover part 30 are tapered in an upward direction in the opened state.

The various Figures show some glue surfaces which serve to form the desired, stable box from a blank and to fix insert pieces to the bottom part. These glue surfaces in the form of pivotable flaps at the various edges are not designated by reference numerals. However, after the foregoing their function will be understood.

The invention is not limited to the embodiments described above.

The drawing invariably shows a box for ten eggs. It will be obvious that the invention is not limited to said number and that boxes capable of holding other numbers of eggs lie within the scope of the invention.

Moreover, the pyramidal elements 18, 19, 20 may be rounded off or even be round and the shape of the holes 9 is bound to that shown in FIGS. 2 and 5; it is sufficient to establish an adequately firm connection between the insert piece and the bottom part.

It will be obvious that instead of using glue surfaces tags co-operating with slots may be used as well for obtaining a rugged box.

Figure 12:
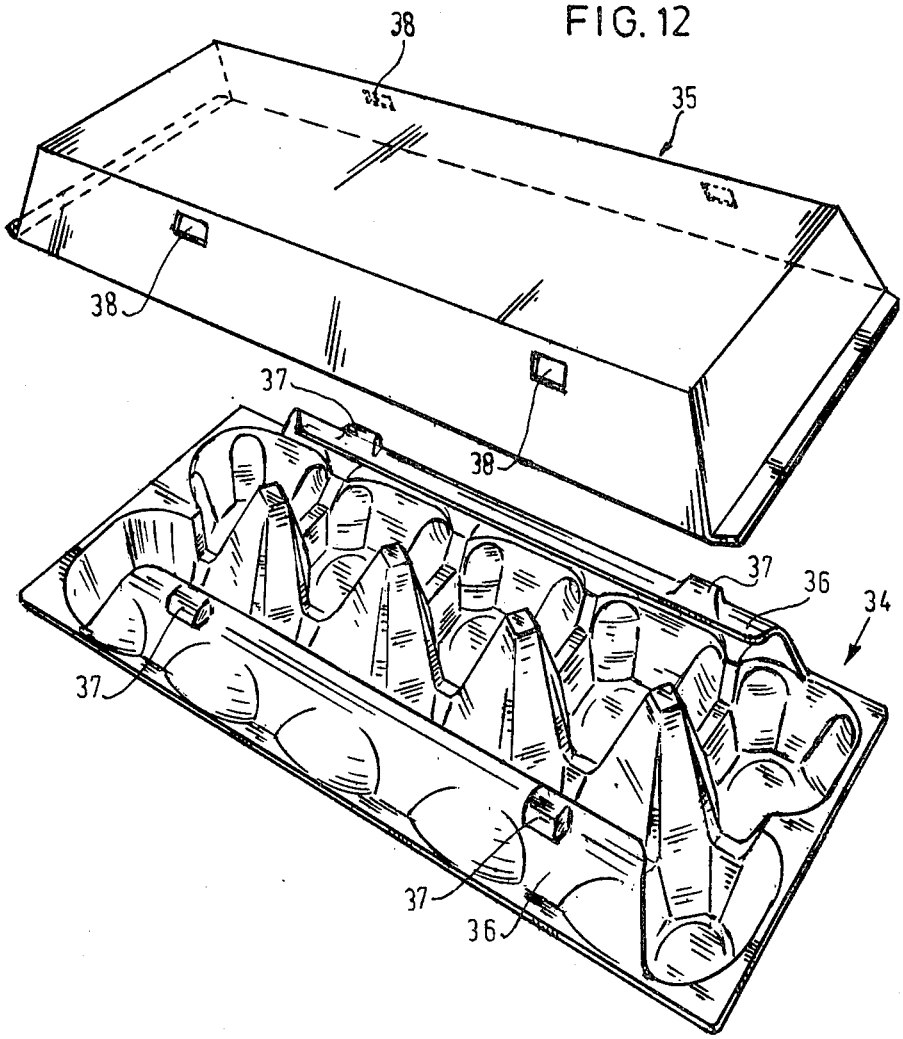
FIG. 12 is a perspective view of a fourth embodiment of the box in accordance with the invention.

FIG. 12 shows a simple variant comprising a bottom part 34 of pulp material and a separate cover part 35 having outer surfaces well adapted to receive prints. The cover part 35 has standing, slightly resilient tags 36 with snap elements 37 for co-operation with holes 38 in the cover part. The variant 34, 35 does not have the same advantages as the embodiments described above, but it is very important that the cover part can be satisfactorily printed.

We claim:

1. A box for transporting and selling eggs in fixed amounts comprising:

a bottom portion including upwardly projecting standing sidewalls being substantially flat and being tapered from a bottom wall to project upwardly and outwardly, said bottom wall including cutout sections;

a cover portion including, in a closed position relative to said bottom portion, downwardly projecting standing sidewalls being substantially flat and being tapered from a top wall to project downwardly and outwardly to engage with said upwardly projecting standing sidewalls of said bottom portion in said closed position;

engagement means for releasably retaining said top portion relative to said bottom portion in said closed position; and a separate egg supporting insert being disposed within said bottom portion for accommodating a plurality of eggs in a spaced apart arrangement;

said cover in an open position being substantially coplanar with respect to said bottom portion for permitting nesting of a plurality of empty boxes wherein a cover portion of a first box will nest with a cover portion of a juxtapositioned box with the top wall of said first box being spaced from the top wall of said juxtapositioned box and said tapered sidewalls of said cover portion of said first box being partially in contact with said tapered sidewalls of said cover portion of said juxtapositioned box and said insert in said first box projecting through said cutout sections of said juxtapositioned box and being in contact with said insert of said juxtapositioned box and said bottom wall of said first box being spaced from the bottom wall of said juxtapositioned box and said tapered sidewalls of said bottom portion of said first box being in partial contact with said tapered sidewalls of said bottom portion of said juxtapositioned box;

said cover portion and said bottom portion being constructed of a material receptive to printing wherein indicia may be directly imprinted on an exterior surface of said top wall and tapered sidewalls of both said cover portion and said bottom portion.

2. A box according to claim 1, wherein said insert is constructed of a soft synthetic resin.

3. A box according to claim 1, wherein said insert is constructed of pulp material.

4. A box according to claim 1, wherein said insert includes a row of pyramids and pyramid parts arranged around said row of pyramids for individually retaining a plurality of eggs in spaced apart relationship therebetween.

5. A box according to claim 1, wherein indicia is printed on said exterior surfaces of said top wall and tapered sidewalls of both said cover portion and said bottom portion which forms a continuous image when closed boxes are stacked one upon another.

6. A box according to claim 1, wherein said engagement means includes openings in a tapered sidewall of said cover portion which mate with snap elements projecting outwardly from a tapered sidewall of said bottom portion when said cover is in the closed position.

* * * * *